US007183482B2

(12) United States Patent
Kobayashi

(10) Patent No.: US 7,183,482 B2
(45) Date of Patent: Feb. 27, 2007

(54) SINGING VOICE SYNTHESIZING METHOD, SINGING VOICE SYNTHESIZING DEVICE, PROGRAM, RECORDING MEDIUM, AND ROBOT APPARATUS

(75) Inventor: Kenichiro Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/548,280

(22) PCT Filed: Mar. 19, 2004

(86) PCT No.: PCT/JP2004/003753

§ 371 (c)(1),
(2), (4) Date: Sep. 9, 2005

(87) PCT Pub. No.: WO2004/084174

PCT Pub. Date: Sep. 30, 2004

(65) Prior Publication Data

US 2006/0156909 A1 Jul. 20, 2006

(30) Foreign Application Priority Data

Mar. 20, 2003 (JP) ..... 2003-079150

(51) Int. Cl.
*G10H 7/00* (2006.01)

(52) U.S. Cl. ..... 84/645; 704/268

(58) Field of Classification Search ..... 84/645; 704/268
See application file for complete search history.

(56) References Cited

U.S. PATENT DOCUMENTS

| | | | | |
|---|---|---|---|---|
| 4,527,274 | A * | 7/1985 | Gaynor | 704/267 |
| 5,235,124 | A * | 8/1993 | Okamura et al. | 434/307 A |
| 5,642,470 | A * | 6/1997 | Yamamoto et al. | 704/270 |
| 5,998,725 | A * | 12/1999 | Ohta | 84/627 |
| 6,304,846 | B1 * | 10/2001 | George et al. | 704/270 |
| 6,424,944 | B1 * | 7/2002 | Hikawa | 704/260 |

FOREIGN PATENT DOCUMENTS

| | | |
|---|---|---|
| JP | 63-8795 | 1/1988 |
| JP | 6-337690 | 12/1994 |
| JP | 10-319955 | 12/1998 |
| JP | 11-184490 | 7/1999 |
| JP | 2001-282269 | 10/2001 |
| JP | 2002-132281 | 5/2002 |

* cited by examiner

*Primary Examiner*—Jeffrey W Donels
(74) *Attorney, Agent, or Firm*—Oblon, Spivak, McClelland, Maier & Neustadt, P.C.

(57) ABSTRACT

A singing voice synthesizing method synthesizes the singing voice by exploiting performance data, such as MIDI data. The input performance data are analyzed as the musical information including the pitch and the length of the sounds and the lyric (S2 and S3). If the musical information analyzed lacks in the lyric information, an arbitrary lyric is donated to an arbitrary string of notes (S9, S11, S12 and S15). The singing voice is generated based on the so donated lyric (S17).

18 Claims, 11 Drawing Sheets

| Track | Channel | Time | Type | Pitch | Length | Velocity | Length | Control type |
|---|---|---|---|---|---|---|---|---|
| | | | ⋮ | | | | | |
| 1 | 1 | 5:03:480 | Control | – | – | – | – | Vibrato (depth 64, width 64, delay 50) |
| 1 | 1 | 5:03:480 | Note | G4 | 199 | 100 | あ | |
| 1 | 1 | 5:04:000 | Note | F#4 | 439 | 108 | る | |
| 1 | 1 | 5:04:480 | Note | G4 | 199 | 100 | う | |
| 1 | 1 | 6:01:000 | Note | E4 | 199 | 90 | ひ | |
| 2 | 1 | 4:01:480 | Control | – | – | – | – | Expression (110) |
| 2 | 1 | 4:01:480 | Control | – | – | – | – | Vibrato (depth 64, width 64, delay 50) |
| 2 | 1 | 6:01:480 | Note | G3 | 199 | 100 | あ | |
| 2 | 1 | 6:02:000 | Note | F#3 | 439 | 108 | る | |
| 2 | 1 | 6:02:480 | Note | G3 | 199 | 100 | う | |
| 2 | 1 | 6:03:000 | Note | E3 | 199 | 90 | ひ | |
| | | | ⋮ | | | | | |

FIG.2

| | |
|---|---|
| ¥song¥ | ← Beginning of singing voice data |
| ¥PP,T10673075¥ | ← Pause of 10673075 μ sec |
| ¥tdyna 110 649075¥ | ← Overall velocity of 10673075 μ sec from the beginning |
| ¥fine-100¥ | ← Fine pitch adjustment (same as fine tune of MIDI) |
| ¥vibrato NRPN_dep=64¥ | ← Vibrato |
| ¥vibrato NRPN_del=50¥ | |
| ¥vibrato NRPN_rat=64¥ | |
| ¥dyna 100¥ | ← Strong/weak per sound |
| ¥G4,T288461¥あ | ← Sound with pitch of G4 length of 288461 μ sec, lyric is 'あ' |
| ¥dyna 108¥ | |
| ¥Gb4,T288462¥る | |
| ¥dyna 100¥ | |
| ¥G4,T288461¥う | |
| ¥dyna 90¥ | |
| ¥E4,T219592¥ひ | |
| ¥PP,T1222716¥ | |
| ¥dyna 100¥ | |
| ¥E4,T144231¥も | |
| ¥dyna 98¥ | |
| ¥E4,T144230¥り | |
| ⋮ | |

FIG.3

| Track | Channel | Time | Type | Pitch | Length | Velocity | Length | Control type |
|---|---|---|---|---|---|---|---|---|
| | | | ⋮ | | | | | |
| 1 | 1 | 2:01:000 | Note | Ab4 | 456 | 70 | – | |
| 1 | 1 | 2:01:000 | Control | – | – | – | – | pedal (0) |
| 1 | 1 | 2:02:000 | Note | G4 | 228 | 40 | – | |
| 1 | 1 | 2:02:240 | Note | Ab4 | 228 | 45 | – | |
| 1 | 1 | 2:03:000 | Note | C5 | 228 | 47 | – | |
| 1 | 1 | 2:03:240 | Note | Bb4 | 228 | 38 | – | |
| 1 | 1 | 3:01:000 | Note | G4 | 228 | 45 | – | |
| 1 | 1 | 3:01:240 | Note | Ab4 | 228 | 38 | – | |
| 1 | 1 | 3:02:000 | Note | Bb4 | 228 | 42 | – | |
| | | | ⋮ | | | | | |

FIG.5

| | |
|---|---|
| ¥song¥ | ← Beginning of singing voice data |
| ¥vol 127¥ | ← Overall velocity |
| ¥PP,2000000¥ | ← Pause of 2000000 μ sec |
| ¥dyna 70¥ | ← Strong/weak per sound |
| ¥Ab4,T496091¥ら | ← Sound with pitch of Ab4 length of 496091 μ sec, lyric is 'ら' |
| ¥dyna 40¥ | |
| ¥G4,T496094¥ら | |
| ¥dyna 45¥ | |
| ¥Ab4,T131595¥ら | |
| ¥dyna 47¥ | |
| ¥C5,T123617¥ら | |
| ¥dyna 38¥ | |
| ¥Bb4bT120000¥ら | |
| ¥dyna 45¥ | |
| ¥G4,T120000¥ら | |
| ¥dyna 38¥ | |
| ¥Ab4,T120000¥ら | |
| ¥dyna 42¥ | |
| ¥Bb4,T120000¥ら | |
| ⋮ | |

FIG.6

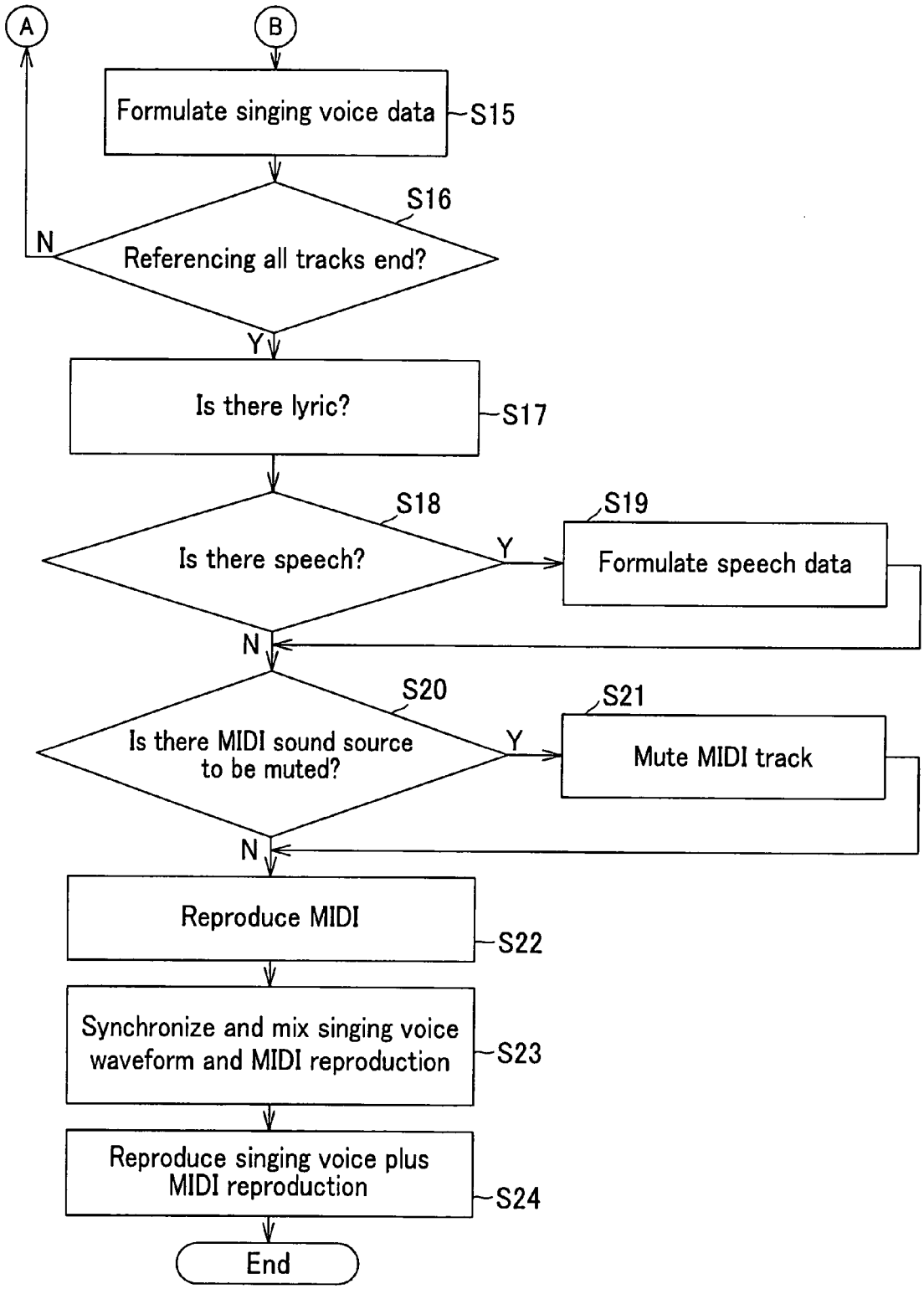
CONTINUATION OF FIG.7

SINGING VOICE SYNTHESIZING METHOD, SINGING VOICE SYNTHESIZING DEVICE, PROGRAM, RECORDING MEDIUM, AND ROBOT APPARATUS

TECHNICAL FIELD

This invention relates to a method and an apparatus for synthesizing the singing voice from performance data, a program, a recording medium, and a robot apparatus.

The present invention contains subject-matter related to Japanese Patent Application JP-2003-079150, filed in the Japanese Patent Office on Mar. 20, 2003, the entire contents of which being incorporated herein by reference.

BACKGROUND ART

There has so far been known a technique of synthesizing the singing voice from given singing data by e.g. a computer, as represented by Patent Publication 1.

MIDI (Musical Instrument Digital Interface) data are representative performance data accepted as a de-facto standard in the related technical field. Typically, the MIDI data are used to generate the musical sound by controlling a digital sound source, termed a MIDI sound source, for example, a sound source actuated by MIDI data, such as computer sound source or a sound source of an electronic musical instrument. Lyric data may be introduced into a MIDI file, such as SMF (Standard MIDI file), so that the musical staff with the lyric may thereby be formulated automatically.

An attempt in using the MIDI data as expression by parameters (special data expression) of the singing voice or the phonemic segments making up the singing voice has also been proposed.

While these related techniques attempt to express the singing voice in the data forms of the MIDI data, such attempt is no more than a control with the sense of controlling a musical instrument without exploiting the lyric data inherently owned by MIDI.

It was also not possible with the conventional techniques to render the MIDI data, formulated for musical instruments, into songs without correcting the MIDI data.

On the other hand, the voice synthesizing software, for reading aloud an E-mail or a home page, is put on sale from many producers, including the present Assignee. However, the manner of reading is the usual manner of reading aloud the text.

A mechanical apparatus for performing movements similar to those of a living organism, inclusive of the human being, using electrical or magnetic operations, is called a robot. The use of the robot in Japan dates back to the end of the sixties. Most of the robots used at that time were industrial robots, such as manipulators or transporting robots, aimed to automate the productive operations in a plant or to provide unmanned operations.

Recently, the development of a utility robot, adapted for supporting the human life as a partner for the human being, that is, for supporting human activities in variable aspects of our everyday life, is proceeding. In distinction from the industrial robot, the utility robot is endowed with the ability of learning how to adapt itself on its own to human operators different in personalities or to variable environments in variable aspects of our everyday life. A pet type robot, simulating the bodily mechanism or movements of quadrupeds, such as dogs or cats, or a humanoid robot, designed after the bodily mechanism or movements of the human being, walking on two legs in an erect style, as a model, is being put to practical application.

In distinction from the industrial robot, the utility robot apparatus are able to perform variable movements, centered about entertainment. For this reason, these utility robot apparatus are sometimes called the entertainment robots. Among the robot apparatus of this sort, there are those performing autonomous movements responsive to the information from outside or to inner states.

The artificial intelligence (AI), used for the autonomous robot apparatus, is artificial realization of intellectual functions, such as deduction or judgment. It is further attempted to artificially realize the functions, such as feeling or instinct. Among the expressing means by visual means or natural languages, for expressing the artificial intelligence to outside, there is a means by voice, as an example of the function of the expression employing the natural language.

As the publications of the related technique of the present invention, there are the U.S. Pat. No. 3,233,036 and Japanese Laid-pen Patent Publication H11-95798.

The conventional synthesis of the singing voice uses data of a special style or, even if it uses MIDI data, the lyric data embedded therein cannot be used efficaciously, or MIDI data, prepared for musical instruments, cannot be sung with the sense of humming.

DISCLOSURE OF THE INVENTION

It is an object of the present invention to provide a novel method and apparatus for synthesizing the singing voice whereby it is possible to overcome the problem inherent in the conventional technique.

It is another object of the present invention to provide a method and an apparatus for synthesizing the singing voice whereby it is possible to synthesize the singing voice by exploiting the performance data, such as MIDI data.

It is a further object of the present invention to provide a method and an apparatus for synthesizing the singing voice, in which MIDI data prescribed by a MIDI file (typically SMF) may be sung by speech synthesis, the lyric information, if any, in the MIDI data, may directly be used or another lyric may be substituted for it, the MIDI data devoid of the lyric information may be provided with an arbitrary lyric and sung, and/or a melody may be imparted to separately provided text data and the resulting data may be sung in the manner of a parody.

It is a further object of the present invention to provide a program and a recording medium for having a computer execute the function of synthesizing the singing voice.

It is yet another object of the present invention to provide a robot apparatus for implementing the above-described singing voice synthesizing function.

A method for synthesizing the singing voice according to the present invention comprises an analyzing step of analyzing performance data as the musical information of the pitch and the length of the sound, and a lyric, and a lyric imparting step of imparting the lyric to a string of notes, based on the lyric information of the musical information analyzed, and imparting an optional lyric to an optional string of notes in the absence of the lyric information, and a singing voice generating step of generating the singing voice based on the lyric imparted.

An apparatus for synthesizing the singing voice according to the present invention comprises an analyzing means for analyzing performance data as the musical information of the pitch and the length of the sound and a lyric, a lyric imparting means for imparting the lyric to a string of notes, based on the lyric information of the musical information analyzed, and imparting an optional lyric to an optional string of notes in the absence of the lyric information, and a singing voice generating means for generating the singing voice based on the so imparted lyric.

With the method and the apparatus for synthesizing the singing voice, according to the present invention, it is possible to generate the singing voice information, by analyzing the performance data and by donating an optional lyric to the musical note information, which is based on the pitch, length and the velocity of the sounds, derived from the analysis, and to generate the singing voice, on the basis of the so generated singing voice information. If there is the lyric information in the performance data, the lyric may be sung as a song, whilst an optional lyric may be imparted to an optional string of notes in the performance data.

The performance data used in the present invention are preferably performance data of a MIDI file.

In the absence of instructions for the lyric from outside, the lyric imparting step or means preferably imparts predetermined lyric elements, such as 'ら'(uttered as 'ra') or 'ぼん'(uttered as 'bon') to an optional string of notes in the performance data.

The lyric is preferably imparted to the string(s) of notes included in a track or a channel in the MIDI file.

In this context, it is preferred that the lyric imparting step or means optionally selects the track or the channel.

It is also preferred that the lyric imparting step or means imparts the lyric to the string of notes in the track or channel appearing first in the performance data.

It is additionally preferred that the lyric imparting step or means imparts independent lyrics to plural tracks or channels. By so doing, choruses in duets or trios may readily be realized.

The results of donation of the lyric are preferably saved.

In case the information indicating the speech is included in the lyric information, a speech inserting step or means is desirably further provided for inserting the speech in the lyric for reading the speech aloud with synthetic speech in place of the lyric with the timing of enunciation of the lyric for inserting the speech into the song.

The program according to the present invention allows a computer to execute the singing voice synthesizing function of the present invention. The recording medium according to the present invention is readable by a computer having the program recorded thereon.

A robot apparatus according to the present invention is an autonomous robot apparatus for performing movements in accordance with the input information supplied thereto, and comprises an analyzing means for analyzing performance data as the musical information of the pitch and the length of the sound and the lyric, and a lyric imparting means for imparting the lyric to a string of notes, based on the lyric information of the musical information analyzed, and imparting an optional lyric to an optional string of notes in the absence of the lyric information, and a singing voice generating means for generating the singing voice based on the so imparted lyric. This configuration significantly improves the properties of the robot apparatus as an entertainment robot.

BRIEF DESCRIPTION OF THE DRAWINGS

FIG. 2 shows an example of the music note information of the results of analysis.

FIG. 3 shows an example of the signing voice information.

FIG. 5 shows an example of the musical staff information the lyric has not been allocated to.

FIG. 6 shows an example of the singing voice information.

BEST MODE FOR CARRYING OUT THE INVENTION

Figure 1:
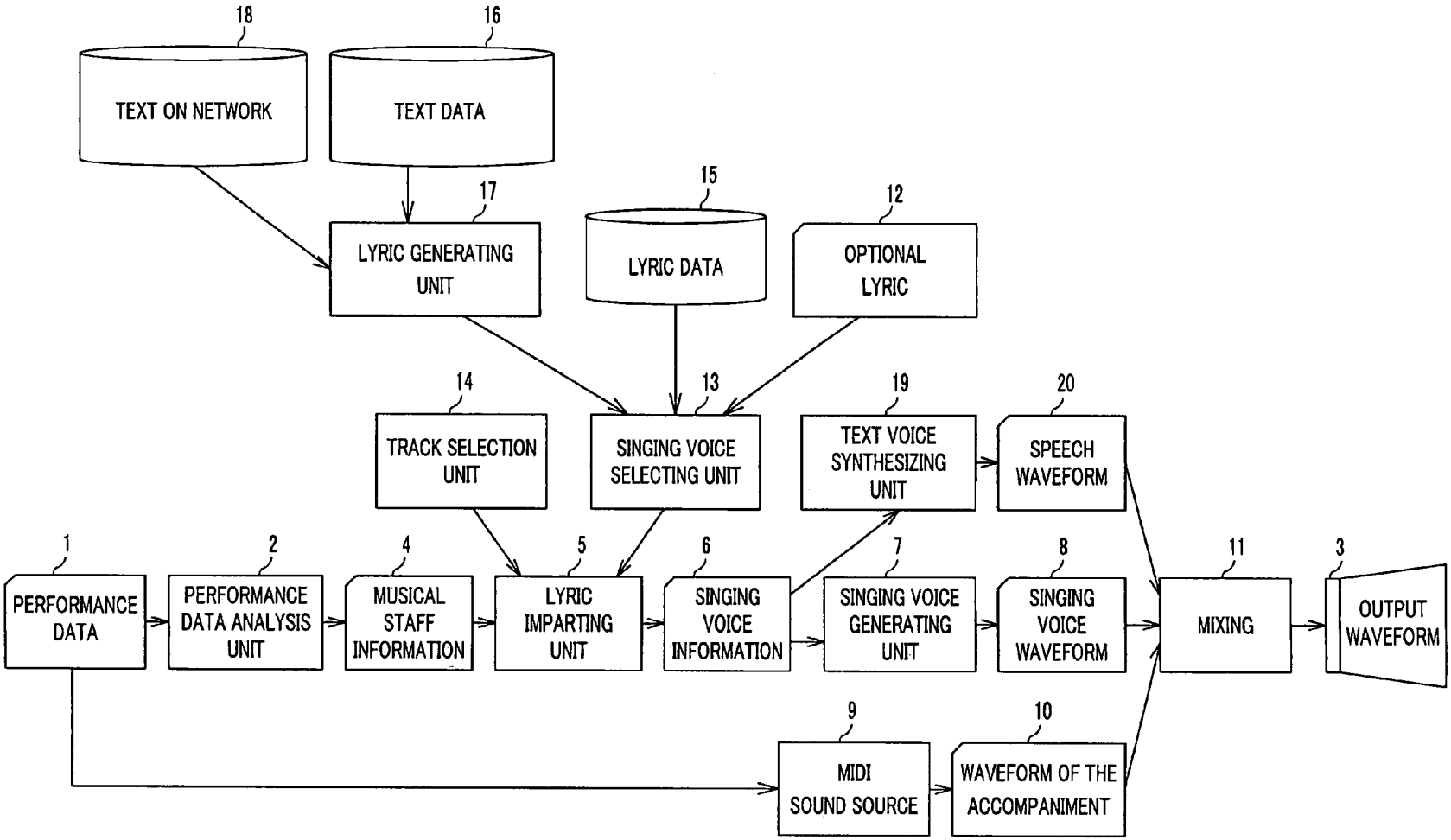
FIG. 1 is a block diagram showing a system configuration of a singing voice synthesizing apparatus according to the present invention.

Referring to the drawings, preferred embodiments of the present invention will be explained in detail.

FIG. 1 shows the system configuration of a singing voice synthesizing apparatus according to the present invention. Although the present singing voice synthesizing apparatus is presupposed to be used for e.g. a robot apparatus which at least includes a feeling model, a speech synthesizing means and an utterance means, this is not to be interpreted in a limiting sense and, of course, the present invention may be applied to a variety of robot apparatus and to a variety of computer AI (artificial intelligence) other than the robot.

In FIG. 1, a performance data analysis unit 2, analyzing performance data 1, typified by MIDI data, analyzes the performance data entered to convert the data into musical staff information 4 indicating the pitch, length and the velocity of the sound of a track or a channel included in the performance data.

FIG. 2 shows an example of performance data (MIDI data) converted into the music staff information 4. Referring to FIG. 2, an event is written from one track to the next and from one channel to the next. The event includes a note event and a control event. The note event has the information on the time of generation (column 'time' in FIG. 2), pitch, length and the intensity (velocity). Hence, a string of musical notes or a string of sounds is defined by a sequence of the note events. The control event includes data showing the time of generation, control type data, such as vibrato, expression of performance dynamics, and control contents. In the case of vibrato, for example, the control contents include items of 'depth' indicating the magnitude of sound pulsations, 'width' indicating the period of sound pulsations, and 'delay' indicating the delay time as from the start timing of the sound pulsations (the utterance timing). The control event for a specified track or channel is applied to the reproduction of the musical sound of the string of sound notes of the track or channel in question, except if there occurs a new control event (control change) for the control type in question. Moreover, in the performance data of the MIDI file, the lyric can be entered on the track basis. In FIG. 2, 'あるう日'('one day', uttered as 'a-ru-u-hi'), indicated in an upper part, is a part of the lyric, entered in a track 1, whilst 'あるう日',indicated in a lower part, is a part of the lyric, entered in a track 2. That is, in the example of FIG. 2, the lyric has been embedded in the music information (musical staff information) analyzed.

In FIG. 2, the time is indicated by "bar: beat: number of ticks", the length is indicated by "number of ticks", the velocity is indicated by a number '0 to 127' and the pitch is indicated by 'A4' for 440 Hz. On the other hand, the depth, width and the delay of the vibrato are represented by the numbers of '0–64–127', respectively.

The musical staff information 4, as converted, is delivered to a lyric imparting unit 5. The lyric imparting unit 5 generates the singing voice information 6, composed of the lyric for a sound, matched to sound notes, along with the information on the length, pitch, velocity and the expression of the sound, for the sound note, in accordance with the musical staff information 4.

FIG. 3 shows examples of the singing voice information 6. In FIG. 3, '¥song¥' is a tag indicating the beginning of the lyric information. A tag '¥PP, T10673075¥' indicates the pause of 10673075 μsec, a tag '¥tdyna 110 649075¥' indicates the overall velocity for 10673075 μsec from the leading end, a tag '¥fine-100¥' indicates fine pitch adjustment, corresponding to fine tune of MIDI, and tags '¥vibrato NRPN_dep=64¥' '¥vibrato NRPN_del=50¥' and '¥vibrato NRPN_rat=64¥' denote the depth, delay and width of the vibrato, respectively. A tag '¥dyna 100¥' denotes the relative velocity from sound to sound, and a tag '¥G4, T288461¥あ' denotes a lyric element 'あ'(uttered as 'a') having a pitch of G4 and a length of 2884611 μsec. The singing voice information of FIG. 3 has been obtained from the musical staff information (results of analysis of MIDI data) shown in FIG. 2. The lyric information of FIG. 3 is obtained from the music staff information shown in FIG. 2 (results of analysis of MIDI data).

As may be seen from comparison of FIGS. 2 and 3, the performance data for controlling the musical instrument, such as the musical staff information, is fully used for generating the singing voice information. For example, as for a component element 'あ'in the lyric part 'あるう日',the time of generation, length, pitch and the velocity thereof, included in the control information or in the note event information in the musical staff information (see FIG. 2), are directly utilized in connection with singing attributes other than 'あ',for example, the time of generation, length, pitch or the velocity of the sound 'あ',the next following note event information in the same track or channel in the musical staff information is also directly used for the next lyric element 'る'(uttered as 'u'), and so on.

Reverting to FIG. 1, the singing voice information 6 is delivered to a singing voice generating unit 7, in which singing voice generating unit 7 a singing waveform 8 is generated based on the singing voice information 6. The singing voice generating unit 7, generating a singing voice waveform 8 from the singing voice information 6, is configured as shown for example in FIG. 4.

Figure 4:
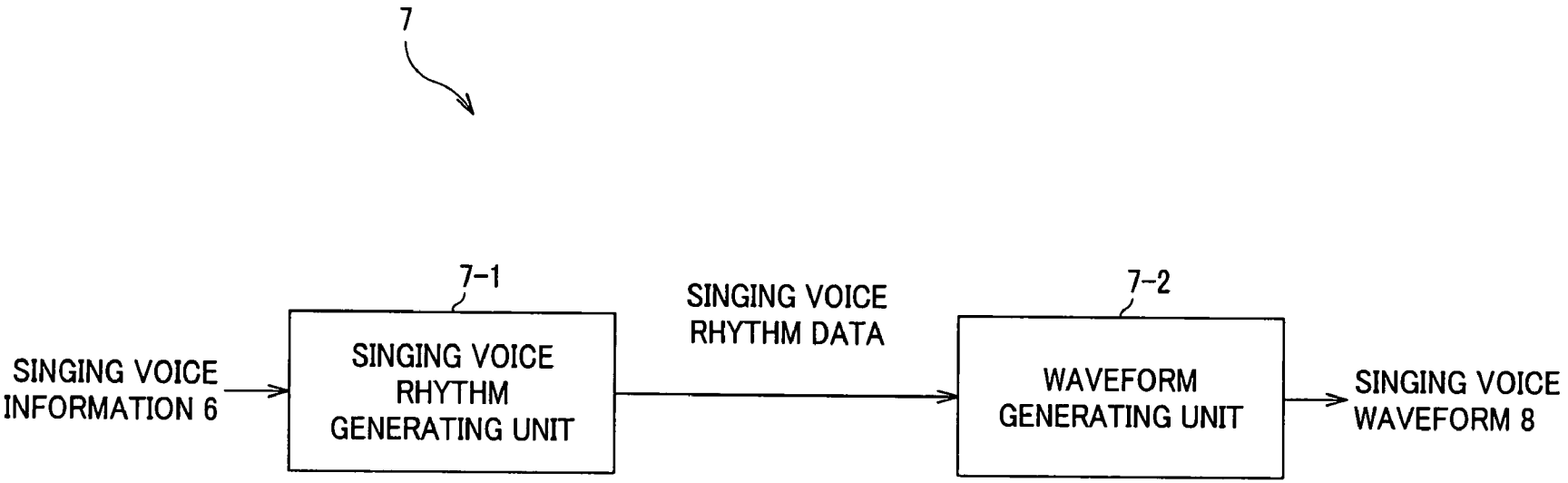
FIG. 4 is a block diagram showing the structure of a singing voice generating unit.

FIG. 4, a singing voice rhythm generating unit 7-1 converts the singing voice information 6 into the singing voice rhythm data. A waveform generating unit 7-2 converts the singing voice rhythm data into the singing voice waveform 8.

As a specified example, the case of expanding the lyric element 'ら'(uttered as 'ra') having a pitch 'A4' a preset time length will now be explained. The singing voice rhythm data in case vibrato is not applied may be represented as indicated in the following Table 1:

TABLE 1

| [LABEL] | | [PITCH] | | [VOLUME] | |
|---|---|---|---|---|---|
| 0 | ra | 0 | 50 | 0 | 66 |
| 1000 | aa | | | 39600 | 57 |

TABLE 1-continued

| [LABEL] | | [PITCH] | | [VOLUME] | |
|---|---|---|---|---|---|
| 39600 | aa | | | 40100 | 48 |
| 40100 | aa | | | 40600 | 39 |
| 40600 | aa | | | 41100 | 30 |
| 41100 | aa | | | 41600 | 21 |
| 41600 | aa | | | 42100 | 12 |
| 42100 | aa | | | 42600 | 3 |
| 42600 | aa | | | | |
| 43100 | a. | | | | |

In the above table, [LABEL] represents the time length of the respective sounds (phoneme elements). That is, the sound (phoneme element) 'ra' has a time length of 1000 samples from sample 0 to sample 1000, and the first sound 'aa', next following the sound 'ra', has a time length of 38600 samples from sample 1000 to sample 39600. The 'PITCH' represents the pitch period, expressed by a point pitch. That is, the pitch period at the sample point 0 is 56 samples. Here, the pitch of 'ら'is not changed, so that the pitch period of 56 samples is applied across the totality of the samples. On the other hand, 'VOLUME' represents the relative sound volume at each of the respective sample points. That is, with the default value of 100%, the sound volume at the 0 sample point is 66%, while that at the 39600 sample point is 57%. The sound volume at the 40100 sample point is 48%, the sound volume is 3% at the 42600 sample point, and so on. This achieves the attenuation of the sound of 'ら'with lapse of time.

On the other hand, if vibrato is applied, the singing voice rhythm data, shown in the following Table 2, are formulated:

TABLE 2

| [LABEL] | | [PITCH] | | [VOLUME] | |
|---|---|---|---|---|---|
| 0 | ra | 0 | 50 | 0 | 66 |
| 1000 | aa | 1000 | 50 | 39600 | 57 |
| 11000 | aa | 2000 | 53 | 40100 | 48 |
| 21000 | aa | 4009 | 47 | 40600 | 39 |
| 31000 | aa | 6009 | 53 | 41100 | 30 |
| 39600 | aa | 8010 | 47 | 41600 | 21 |
| 40100 | aa | 10010 | 53 | 42100 | 12 |
| 40600 | aa | 12011 | 47 | 42600 | 3 |
| 41100 | aa | 14011 | 53 | | |
| 41600 | aa | 16022 | 47 | | |
| 42100 | aa | 18022 | 53 | | |
| 42600 | aa | 20031 | 47 | | |
| 43100 | a. | 22031 | 53 | | |
| | | 24042 | 47 | | |
| | | 26042 | 53 | | |
| | | 28045 | 47 | | |
| | | 30045 | 53 | | |
| | | 32051 | 47 | | |
| | | 34051 | 53 | | |
| | | 36062 | 47 | | |
| | | 38062 | 53 | | |
| | | 40074 | 47 | | |
| | | 42074 | 53 | | |
| | | 43010 | 50 | | |

As indicated in the column 'PITCH' of the above Table, the pitch period at a 0 sample point and that at a 1000 sample point are both 50 samples. During this time interval, there is no change in the pitch of the speech. As from this time, the pitch period is swung up and down, in a range of 50±3, at a period (width) of approximately 4000 samples, as exemplified by the pitch periods of 53 samples at 2000 sample point, 47 samples at 4009 sample point and 53 samples at 6009 sample point. In this manner, the vibrato, which is the pulsations of the pitch of the speech, is achieved. The data of the column 'PITCH' is generated based on the information on the corresponding singing voice element in the singing voice information 6, such as 'ら',in particular the note number, such as A4, and the vibrato control data, such as tag '¥vibrato NRPN_dep=64¥',, 'vibrato NRPN_del=50¥'or '¥vibrato NRPN_rat=64¥'.

Based on the above singing voice phoneme data, the waveform generating unit 7-2 reads out samples from an internal waveform memory, not shown, to generate the singing voice waveform 8. It is noted that the singing voice generating unit 7, adapted for generating the singing voice waveform 8 from the singing voice information 6, is not limited to the above embodiment, such that any suitable known unit for generating the singing voice may be used.

Reverting to FIG. 1, the performance data 1 is delivered to a MIDI sound source 9, which MIDI sound source 9 then generates the musical sound based on the performance data. The musical sound generated is a waveform of the accompaniment 10.

The singing voice waveform 8 and the waveform of the accompaniment 10 are delivered to a mixing unit 11 adapted for synchronizing and mixing the two waveforms with each other.

The mixing unit 11 synchronizes the singing voice waveform 8 with the waveform of the accompaniment 10 and superposes the two waveforms together to generate and reproduce the so superposed waveforms. Thus, music is reproduced by the singing voice, with the accompaniment, attendant thereon, based on the performance data 1.

If, in the stage of conversion to the singing voice information 6 by the lyric imparting unit 5, based on the musical staff information 4, the lyric information is present in the musical staff information 4, the singing voice information 6 is imparted as the lyric present as the information is prioritized. As aforesaid, FIG. 2 shows an example of the musical staff information 4, the lyric has been imparted to, and FIG. 3 shows an example of the singing voice information 6, generated from the musical staff information 4 of FIG. 2.

Meanwhile, it is to the string of notes for the track or channel of the musical staff information 4, as selected by the track selecting unit 14, that the lyric is imparted by the lyric imparting unit 5, based on the musical staff information 4.

If, in the musical staff information 4, there is no lyric in any track or channel, the lyric imparting unit 5 imparts an optional lyric to the string of notes, as selected by the track selecting unit 14, based on optional lyric data 12, for example, 'ら'or 'ぼん'(uttered as 'bon'), as specified by an operator in advance by the lyric selecting unit 13.

FIG. 5 shows an example of the musical staff information 4, to which no lyric is allocated, and FIG. 6 shows an example of the singing voice information 6, corresponding to the musical staff information of FIG. 5, in which 'ら'is registered as optional lyric element.

Meanwhile, In FIG. 5, the time is indicated by "bar: beat: number of ticks", the length is indicated by "number of ticks", the velocity is indicated by a number '0 to 127' and the pitch is indicated by 'A4' for 440 Hz.

Referring to FIG. 1, an operator may specify the donation of lyric data of any optional reading, as optional lyric data 12, by the lyric selecting unit 13. In the absence of designation by the operator, 'ら'is set by way of a default value of the optional lyric data 12.

The lyric selecting unit 13 is able to impart lyric data 15, provided in advance externally of the singing voice synthesizing apparatus, to the string of notes as selected by the track selecting unit 14.

The lyric selecting unit 13 may also convert text data 16, such as E-mail or document prepared on a word processor, into readings by the lyric generating unit 17, to select an optional string of letters/characters as lyric. It is noted that the technique of converting the string of letters/characters composed of a kanji-kana mixed sentence(s) is well-known as the application of 'morphemic analysis'.

Meanwhile, the text of interest may be a text 18 on a network, distributed over the network.

According to the present invention, if the information indicating the lines (speech or narration) is included in the lyric information, the lines may be read aloud with the synthesized voice, at the timing of enunciating the lyric, in place of the lyric, thereby introducing the lines into the lyric.

For example, if there is a speech tag, such as '//幸せだなー'('How lucky it is for me!', uttered as 'shia-wase-da-na-'), in the MIDI data, '¥SP, T2345696¥幸せだなー' is added, as the information indicating that the lyric part in question is the speech, to the lyric of the singing voice information 6 generated by the lyric imparting unit 5. In this case, the speech part is delivered to a text voice synthesizing unit 19 to generate a speech waveform 20. It is readily possible to express the information, representing the speech, on the letter/character string level, using a tag exemplified by '¥SP, T¥ speech'.

The speech waveform may also be generated by adding the silent waveform, ahead of the speech, by making divertive use of the rest information in the singing voice information, by way of the timing information for representing the speech.

The track selecting unit 14 may advise the operator of the number of tracks in the musical staff information 4, the number of channels in the respective tracks or the presence/absence of the lyric, in order for the operator to select which lyric is to be imparted to which track or channel in the musical staff information 4.

In case the lyric has been imparted to the track or channel in the track selecting unit 14, the track selecting unit 14 selects the track or channel the lyric has been imparted to.

If no lyric is imparted, it is verified which track or channel is to be selected under a command from the operator. Of course, the operator may optionally donate an optional lyric to the track or channel the lyric has already been imparted to.

If there is neither the lyric imparted nor the operator's command, a first channel of the first track is apprized to the lyric imparting unit 5, by way of default, as a string of notes of interest.

The lyric imparting unit 5 generates the singing voice information 6, using the lyric, selected by the lyric selecting unit 13, or the lyric, stated in the track or channel, for the string of notes indicated by the track or the channel selected by the track selecting unit 14, based on the musical staff information 4. This processing may be carried out independently for each of the respective tracks or channels.

Figure 7:
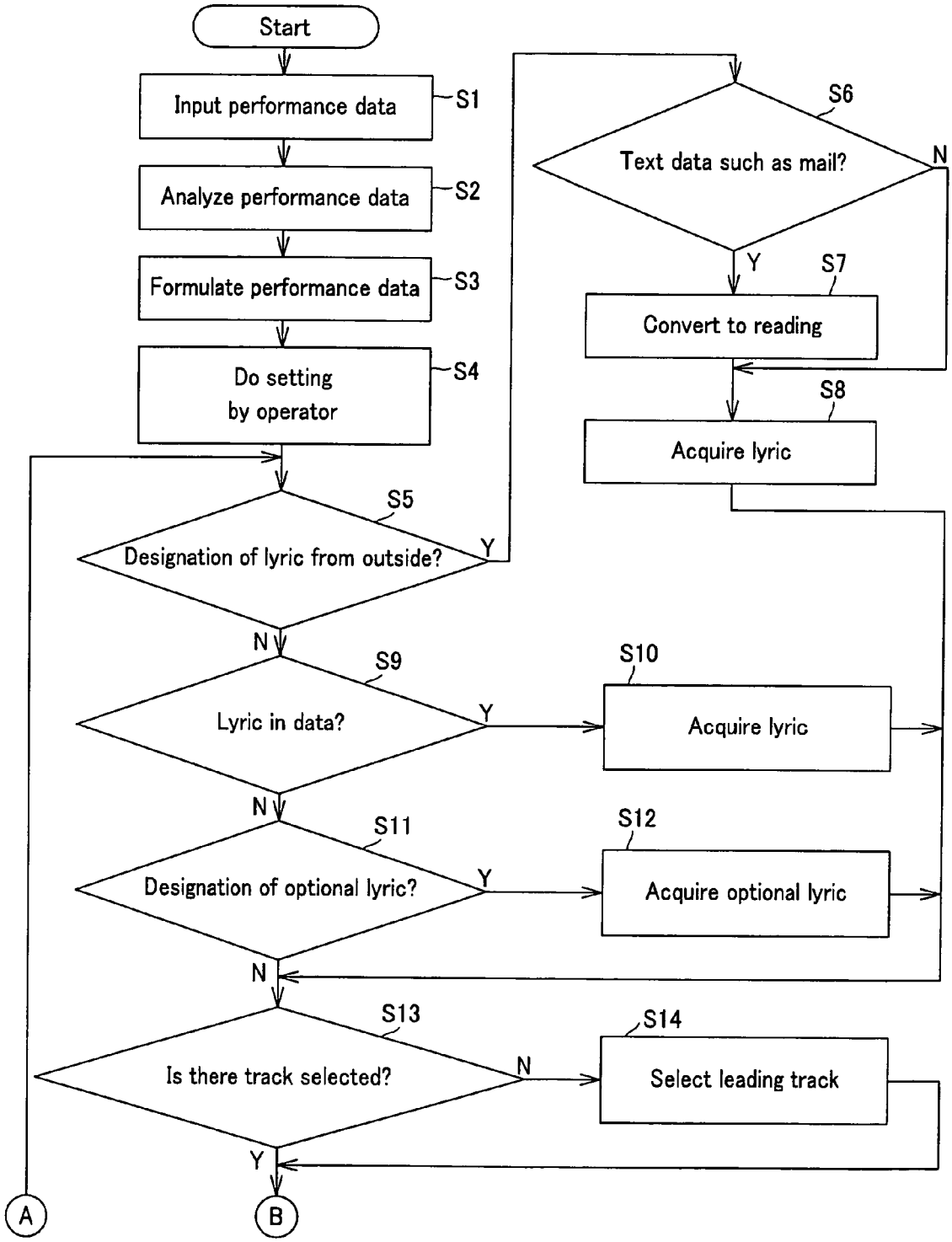
FIG. 7 is a flowchart for illustrating the operation of the singing voice synthesizing apparatus according to the present invention.

FIG. 7 depicts the flowchart for illustrating the overall operation of the singing voice synthesizing apparatus shown in FIG. 1.

Referring to FIG. 7, the performance data 1 of the MIDI file is entered first of all (step S1). The performance data 1 then is analyzed, and the musical staff data 4 then is entered (steps S2 and S3). An enquiry then is made to an operator, who then carries out the processing for setting, such as selecting the lyric, selecting the track or the channel, as the subject of the lyric, or selecting the MIDI track or channel to be muted (step S4). Insofar as the operator has not carried out the setting, default setting is applied in the subsequent processing.

The next following steps S5 to S16 represent the processing for adding the lyric. If a lyric has been designated from outside for the track of interest (step S5), this lyric comes first in the priority ranking. Hence, processing transfers to a step S6. If the specified lyric is text data 16, 18, such as E-nail, the text data is converted into readings (step S7) and the lyric is subsequently acquired. If the specified lyric is not text data, but is e.g. lyric data 15, the lyric, so designated from outside, is directly acquired as the lyric (step S8).

If no lyric has been specified from outside, it is checked whether or not there is lyric within the musical staff information 4 (step S9). The lyric present in the musical staff information comes second in the priority ranking, so that, if the result of check of the above step is affirmative, the lyric in the musical staff information is acquired (step S10).

If there is no lyric in the musical staff information 4, it is checked whether or not an optional lyric has been specified (step S11). When the optional lyric has been specified, optional lyric data 12 for the optional lyric is acquired (step S12).

If the result of check in the optional lyric decision step S11 is negative, or after the lyric acquisition steps S8, S10 or S12, it is checked whether or not the track, the lyric is to be allocated to, has been selected (step S13). When there is no selected track, the leading track is selected (step S19). Specifically, the channel of the track, appearing first of all, is selected.

The above decides on the track and the channel, the lyric is to be allocated to, and hence the singing voice information 6 is prepared from the lyric, using the musical staff information 4 of the track in the track (step S15).

It is then checked whether or not the processing has been completed for the totality of the tracks (step S16). When the processing has not been completed, processing is carried out for the next track and then reverts to the step S5.

Thus, when the lyric is added to each of plural tracks, the lyric is added independently to the separate tracks to formulate the singing voice information 6.

That is, with the lyric adding process, shown in FIG. 7, if there is no lyric information in the analyzed musical information, an optional lyric is added to an optional string of notes. If no lyric is specified from outside, a preset lyric element, such as 'ら'or 'ぼん',may be imparted to an optional string of notes. The string of notes, contained in the track or the channel of the MIDI file, is also the subject of donation of the lyric. In addition, the track or channel, the lyric is allocated to, may optionally be selected through the processing of operator setting (S4).

After the process of adding the lyric, processing transfers to a step 17, where the singing voice waveform 8 is formulated from the singing voice information 6 by the singing voice generating unit 7.

Next, if there is the speech in the singing voice information (step S18), the speech waveform 20 is formulated by the text voice synthesizing unit 19 (step S19). Thus, when the information indicating the speech has been included in the lyric information, the speech is read aloud by the synthesized voice, to take the place of the lyric, with the timing of enunciation of the relevant lyric part, thus introducing the speech in the song.

It is then checked whether or not there is the MIDI sound source to be muted (step S20). If there is the MIDI sound source to be muted, the relevant MIDI track or channel is muted (step S21). This mutes the musical sound of the track or the channel the lyric has been allocated to. The MIDI is then reproduced by the MIDI sound source 9 to formulate the waveform of accompaniment 10 (step S21).

By the above processing, the singing voice waveform 8, speech waveform 20 and the waveform of accompaniment 10 are produced.

By the mixing unit 11, the singing voice waveform 8, speech waveform 20 and the waveform of accompaniment 10 are synchronized and superposed together to reproduce the resulting waveforms, superposed together, as an output waveform 3 (steps S23 and S24). This output waveform 3 is output via a sound system, not shown, as acoustic signals.

In the last step S24 or in an optional part-way step, for example, in a stage where the generation of the singing voice waveform and the speech waveform has come to a close, the results of processing, such as the results of donation of the lyric or the donation of the speech, may be saved.

The singing voice synthesizing function, described above, is installed in e.g. a robot apparatus.

The robot apparatus of the type walking on two legs, shown as an embodiment of the present invention, is a utility robot supporting human activities in various aspects of our everyday life, such as in our living environment, and is able to act responsive to an inner state, such as anger, sadness, pleasure or happiness. At the same time, it is an entertainment robot capable of expressing basic behaviors of the human being.

Figure 8:
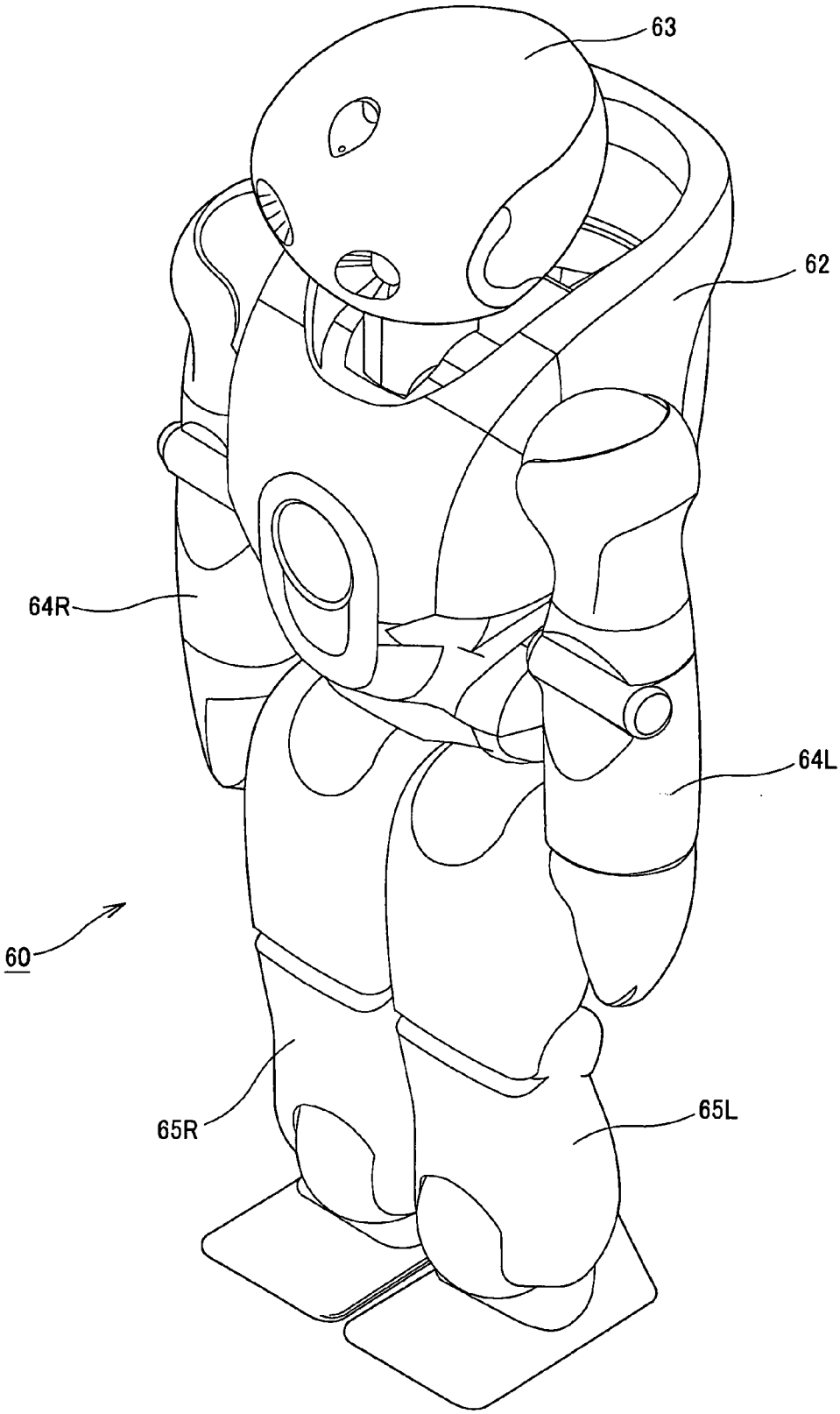
FIG. 8 is a perspective view showing the appearance of a robot apparatus according to the present invention.

Referring to FIG. 8, the robot apparatus 60 is formed by a body trunk unit 62, to preset positions of which there are connected a head unit 63, left and right arm units 64R/L and left and right leg units 65R/L, where R and L denote suffixes indicating right and left, respectively, hereinafter the same.

Figure 9:
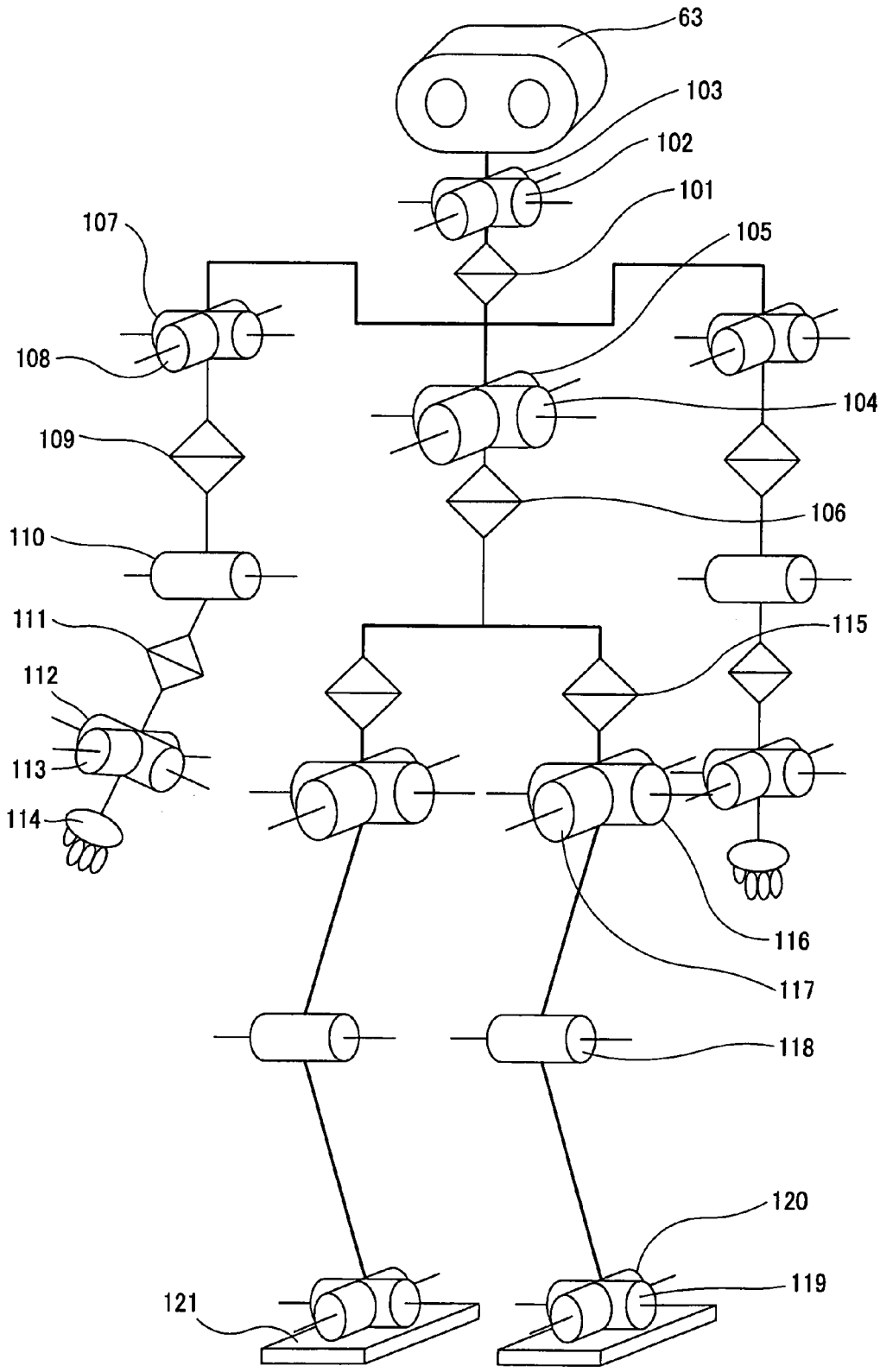
FIG. 9 schematically shows a model of the structure of the degrees of freedom of a robot apparatus.

The structure of the degrees of freedom of the joints, provided for the robot apparatus 60, is schematically shown in FIG. 9. The neck joint, supporting the head unit 63, includes three degrees of freedom, namely a neck joint yaw axis 101, a neck joint pitch axis 102 and a neck joint roll axis 103.

The arm units 64R/L, making up upper limbs, are formed by a shoulder joint pitch axis 107, a shoulder joint roll axis 108, an upper arm yaw axis 109, an elbow joint pitch axis 110, a forearm yaw axis 111, a wrist joint pitch axis 112, a wrist joint roll axis 113 and a hand unit 114. The hand unit 114 is, in actuality, a multi-joint multi-freedom-degree structure including plural fingers. However, since the movements of the hand unit 114 contribute to or otherwise affect posture control or walking control for the robot apparatus 60, only to a lesser extent, the hand unit is assumed in the present description to have a zero degree of freedom. Consequently, the arm units are each provided with seven degrees of freedom.

The body trunk unit 62 also has three degrees of freedom, namely a body trunk pitch axis 104, a body trunk roll axis 105 and a body trunk yaw axis 106.

Each of leg units 65R/L, forming the lower limbs, is made up by a hip joint yaw axis 115, a hip joint pitch axis 116, a hip joint roll axis 117, a knee joint pitch axis 118, an ankle joint pitch axis 119, an ankle joint roll axis 120, and a leg unit 121. In the present description, the point of intersection of the hip joint pitch axis 116 and the hip joint roll axis 117 prescribes the hip joint position of the robot apparatus 60. Although the leg unit 121 of the human being is, in actuality, a structure including the foot sole having multiple joints and multiple degrees of freedom, the foot sole of the robot apparatus is assumed to be of the zero degree of freedom. Consequently, each leg has six degrees of freedom.

In sum, the robot apparatus 60 in its entirety has a sum total of 3+7×2+3+6×2=32 degrees of freedom. It is noted however that the number of the degrees of freedom of the robot apparatus for entertainment is not limited to 32, such that the number of the degrees of freedom, that is, the number of joints, may be suitably increased or decreased depending on the constraint conditions in designing or in manufacture or on required design parameters.

The above-described degrees of freedom, owned by the above-described robot apparatus 60, are actually mounted using an actuator. In view of a demand for eliminating excess swollenness in appearance to approximate the natural shape of the human being, and for enabling posture control of an unstable structure resulting from walking on two legs, the actuator is desirably small-sized and lightweight. It is more preferred for the actuator to be designed and constructed as a small-sized AC servo actuator of the direct gear coupling type in which a servo control system is arranged as one chip and mounted in a motor unit.

Figure 10:
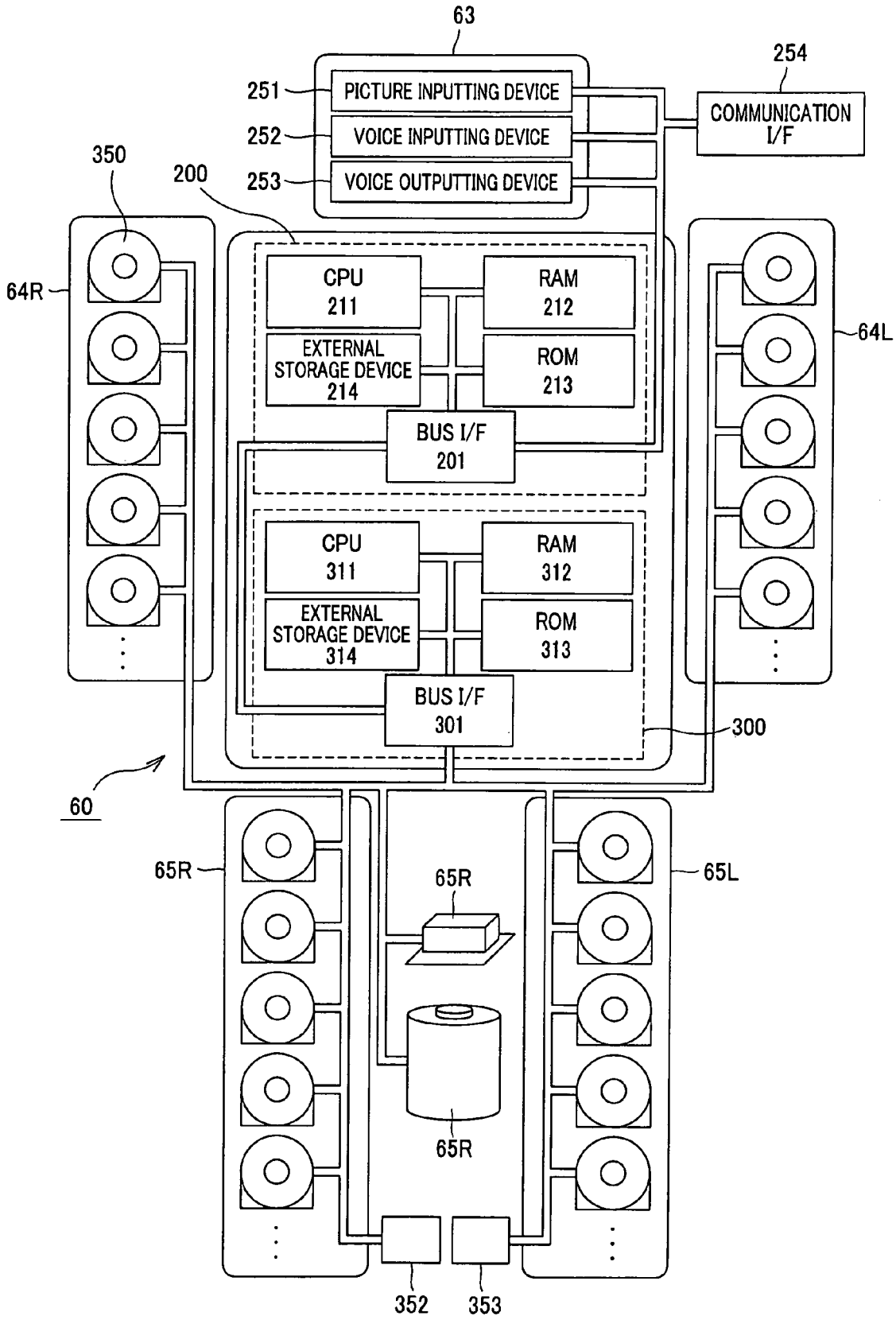
FIG. 10 is a schematic block diagram showing a system structure of the robot apparatus.

FIG. 10 schematically shows a control system structure of the robot apparatus 60. Referring to FIG. 10, the control system is made up by a thinking control module 200, taking charge of emotional judgment or feeling expression, in response dynamically to a user input, and a movement control module 300 controlling the concerted movement of the entire body of the robot apparatus 60, such as driving of an actuator 350.

The thinking control module 200 is an independently driven information processing apparatus, which is made up by a CPU (central processing unit) 211, carrying out calculations in connection with emotional judgment or feeling expression, a RAM (random access memory) 212, a ROM (read-only memory) 213, and an external storage device (e.g. a hard disc drive) 214, and which is capable of performing self-contained processing within a module.

This thinking control module 200 decides on the current feeling or will of the robot apparatus 60, in accordance with the stimuli from outside, such as picture data entered from a picture inputting device 251 or voice data entered from a voice inputting device 252. The picture inputting device 251 includes e.g. a plural number of CCD (charge coupled device) cameras, while the voice inputting device 252 includes a plural number of microphones.

The thinking control module 200 issues commands for the movement control module 300 in order to execute a sequence of movements or behavior, based on decisions, that is, the movements of the four limbs, The movement control module 300 is an independently driven information processing apparatus, which is made up by a CPU (central processing unit) 311, controlling the concerted movement of the entire body of the robot apparatus 60, a RAM 312, a ROM 313, and an external storage device (e.g. a hard disc drive) 314, and which is capable of performing self-contained processing within a module. The external storage device 314 is able to store an action schedule, including a walking pattern, as calculated off-line, and a targeted ZMP trajectory. It is noted that the ZMP is a point on a floor surface where the moment by the force of reaction exerted from the floor during walking is equal to zero, while the ZMP trajectory is the trajectory along which moves the ZMP during the walking period of the robot apparatus 60. As for the concept of ZMP and application of ZMP for the criterion of verification of the degree of stability of a walking robot, reference is made to Miomir Vukobratovic, "LEGGED LOCOMOTION ROBOTS" and Ichiro KATO et al., "Walking Robot and Artificial Legs", published by NIKKAN KOGYO SHIMBUN-SHA.

To the movement control module 300, there are connected e.g. actuators 350 for realization of the degrees of freedom, distributed over the entire body of the robot apparatus 60, shown in FIG. 9, a posture sensor 351, for measuring the posture of tilt of a body trunk unit 62, floor touch confirming sensors 352, 353 for detecting the flight state or the stance state of the foot soles of the left and right feet, and a power source control device 354 for supervising a power source, such as a battery, over a bus interface (I/F) 301. The posture sensor 351 is formed e.g. by the combination of an acceleration sensor and a gyro sensor, while the floor touch confirming sensors 352, 353 are each formed by a proximity sensor or a micro-switch.

The thinking control module 200 and the movement control module 300 are formed on a common platform and are interconnected over bus interfaces 201, 301.

The movement control module 300 controls the concerted movement of the entire body, produced by the respective actuators 350, for realization of the behavior as commanded from the thinking control module 200. That is, the CPU 311 takes out, from an external storage device 314, the behavior pattern consistent with the behavior as commanded from the thinking control module 200, or internally generates the behavior pattern. The CPU 311 sets the foot/leg movements, ZMP trajectory, body trunk movement, upper limb movement, and the horizontal position as well as the height of the waist part, in accordance with the designated movement pattern, while transmitting command values, for commanding the movements consistent with the setting contents, to the respective actuators 350.

The CPU 311 also detects the posture or tilt of the body trunk unit 62 of the robot apparatus 60, based on output signals of the posture sensor 351, while detecting, by output signals of the floor touch confirming sensors 352, 353, whether the leg units 65R/L are in the flight state or in the stance state, for adaptively controlling the concerted movement of the entire body of the robot apparatus 60.

The CPU 311 also controls the posture or movements of the robot apparatus 60 so that the ZMP position will be directed at all times to the center of the ZMP stabilized area.

The movement control module 300 is adapted for returning to which extent the behavior in keeping with the decision made by the thinking control module 200 has been demonstrated, that is, the status of processing, to the thinking control module 200.

In this manner, the robot apparatus 60 is able to verify the own state and the surrounding state, based on the control program, to carry out the autonomous behavior.

In this robot apparatus 60, the program, inclusive of data, which has implemented the above-mentioned singing voice synthesizing function, resides e.g. in the ROM 213 of the thinking control module 200. In such case, the program for synthesizing the singing voice is run by the CPU 211 of the thinking control module 200.

By providing the robot apparatus with the above-described singing voice synthesizing function, the capacity of express ion of the robot apparatus in singing a song to the accompaniment, is newly acquired, with the result that the properties of the robot apparatus as an entertainment robot are enhanced to further the intimate relationship of the robot apparatus with the human being.

The present invention is not limited to the above-described embodiments and may be modified in desired manner without departing from the scope of the invention.

For example, although the singing voice information usable for the singing voice generating unit 7 corresponding to the singing voice synthesis unit and the waveform generating unit, used in the voice synthesizing method and apparatus, used in turn in the singing voice generating method and apparatus as disclosed in the specification and drawings of the Japanese Patent Application 2002-73385, previously proposed by the present Assignee, has been shown and explained above, a variety of other singing voice generating units may also be used. In this case, it is of course sufficient to generate the singing voice information, containing the information as needed for generating the singing voice, by a variety of singing voice generating units from the above performance data. In addition, the performance data may also be performance data of a large variety of standards, without being limited to the MIDI data.

INDUSTRIAL APPLICABILITY

With the singing voice synthesizing method and apparatus, according to the present invention, in which performance data are analyzed as the music information of the pitch and length of the sounds and as the music information of the lyric, a lyric is imparted to the string of notes based on the lyric information of the analyzed music information, an arbitrary lyric may be imparted to an arbitrary string of notes in the analyzed music information, in the absence of the lyric information, and in which the singing voice is generated based on the so imparted lyric, the performance data may be analyzed and an arbitrary lyric may be imparted to the musical note information, as derived from the pitch, length and the velocity of the sound derived from the analysis, to generate the singing voice information as well as to generate the singing voice based on the so generated singing voice information. If there is lyric information in the performance data, it is possible to sing the lyric. In addition, an arbitrary lyric may be imparted to an optional string of notes in the performance data. Thus, the musical expression may appreciably be improved because the singing voice may be reproduced without adding any special information in the creation or reproduction of music so far expressed only by the sound of the musical instruments.

The program according to the present invention allows a computer to execute the singing voice synthesizing function of the present invention. The recording medium according to the present invention has this program recorded thereon and is computer-readable.

With the program and the recording medium according to the present invention, in which performance data are analyzed as the music information of the pitch and length of the sounds and as the music information of the lyric, a lyric is imparted to the string of notes based on the lyric information of the analyzed music information, an arbitrary lyric may be imparted to an arbitrary string of notes in the analyzed music information, in the absence of the lyric information, and in which the singing voice is generated based on the so imparted lyric, the performance data may be analyzed and an arbitrary lyric may be imparted to the musical note information, as derived from the pitch, length and the velocity of the sound derived from the analysis, to generate the singing voice information as well as to generate the singing voice based on the so generated singing voice information. If there is lyric information in the performance data, it is possible to sing the lyric. In addition, an arbitrary lyric may be imparted to an optional string of notes in the performance data.

The robot apparatus according to the present invention is able to achieve the singing voice synthesizing function according to the present invention. That is, with the autonomous robot apparatus, performing movements based on the input information, supplied thereto, according to the present invention, the input performance data are analyzed as the music information of the pitch and length of the sounds and as the music information of the lyric, a lyric is imparted to the string of notes based on the lyric information of the analyzed music information, an arbitrary lyric may be imparted to an arbitrary string of notes in the analyzed music information, in the absence of the lyric information, and in which the singing voice is generated based on the so imparted lyric, the input performance data may be analyzed and an arbitrary lyric may be imparted to the musical note information, as derived from the pitch, length and the velocity of the sound derived from the analysis, to generate the singing voice information as well as to generate the singing voice based on the so generated singing voice information. If there is lyric information in the performance data, it is possible to sing the lyric. In addition, an arbitrary lyric may be imparted to an optional string of notes in the performance data. The result is that the ability of expressions of the robot apparatus may be improved and the properties of the robot apparatus as an entertainment robot are enhanced to further the intimate relationship of the robot apparatus with the human being.

The invention claimed is:

1. A method for synthesizing the singing voice comprising an analyzing step of analyzing performance data as a musical information of a pitch and a length of a sound and a lyric; and a lyric imparting step of imparting the lyric to a string of notes, based on the lyric information of the musical information analyzed, and imparting an optional lyric to an optional string of notes in the absence of the lyric information; and a singing voice generating step of generating the singing voice based on the lyric imparted.

2. The method for synthesizing the singing voice according to claim 1 wherein said performance data is performance data of a MIDI file.

3. The method for synthesizing the singing voice according to claim 1 wherein said lyric imparting step imparts a predetermined lyric to an optional string of notes in the absence of designation of a particular lyric from outside.

4. The method for synthesizing the singing voice according to claim 2 wherein said lyric imparting step imparts the lyric to a string of notes included in a track or a channel of said MIDI file.

5. The method for synthesizing the singing voice according to claim 4 wherein said lyric imparting step arbitrarily selects said track or the channel.

6. The method for synthesizing the singing voice according to claim 4 wherein said lyric imparting step imparts the lyric to a string of notes of a track or a channel appearing first in the performance data.

7. The method for synthesizing the singing voice according to claim 4 wherein said lyric imparting step imparts an independent lyric to each of a plurality of the tracks or the channels.

8. The method for synthesizing the singing voice according to claim 2 wherein said lyric imparting step stores the results of donation of the lyric.

9. The method for synthesizing the singing voice according to claim 2 further comprising a speech inserting step of reading aloud a speech, by synthesized voice, in place of a lyric in question, at the timing of enunciation of said lyric in question, for introducing the speech into a song, in case the information indicating the speech is included in said lyric information.

10. An apparatus for synthesizing the singing voice comprising:

analyzing means for analyzing performance data as a musical information of a pitch and a length of a sound and a lyric;

lyric imparting means for imparting the lyric to a string of notes, based on the lyric information of the musical information analyzed, and imparting an optional lyric to an optional string of notes in the absence of the lyric information; and singing voice generating means for generating the singing voice based on the lyric imparted.

11. The apparatus for synthesizing the singing voice according to claim 10 wherein said performance data is performance data of a MIDI file.

12. The apparatus for synthesizing the singing voice according to claim 10 wherein said lyric imparting means imparts a predetermined lyric to an optional string of notes in the absence of designation of a particular lyric from outside.

13. The apparatus for synthesizing the singing voice according to claim 11 wherein said lyric imparting means imparts the lyric to a string of notes included in a track or a channel of said MIDI file.

14. The apparatus for synthesizing the singing voice according to claim 11 further comprising speech inserting means for reading aloud a speech, by synthesized speech, in place of a lyric in question, at the timing of enunciation of the lyric in question, for introducing the speech into a song in case the information indicating the speech is included in said lyric information.

15. A computer-readable recording medium, having recorded thereon a program that when executed by a processor portion perform steps comprising:

an analyzing step of analyzing input performance data as a musical information of a pitch and a length of a sound and a lyric;

a lyric imparting step of imparting the lyric to a string of notes, based on the lyric information of the musical information analyzed, and imparting an optional lyric to an optional string of notes in the absence of the lyric information; and a singing voice generating step of generating the singing voice based on the lyric imparted.

16. The recording medium according to claim 15 wherein said performance data is performance data of a MIDI file.

17. An autonomous robot apparatus comprising analyzing means for analyzing performance data as a musical information of a pitch and a length of a sound and a lyric;

lyric imparting means for imparting the lyric to a string of notes, based on the lyric information of the musical information analyzed, and imparting an optional lyric to an optional string of notes in the absence of the lyric information; and singing voice generating means for generating the singing voice based on the lyric imparted.

18. The robot apparatus according to claim 17 wherein said performance data is performance data of a MIDI file.

* * * * *